US006680154B1

(12) United States Patent
Dickerson

(10) Patent No.: US 6,680,154 B1
(45) Date of Patent: Jan. 20, 2004

(54) ASYMMETRIC RADIOGRAPHIC FILM FOR MAMMOGRAPHY AND METHOD OF PROCESSING

(75) Inventor: Robert E. Dickerson, Hamlin, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/431,314

(22) Filed: May 7, 2003

Related U.S. Application Data

(63) Continuation-in-part of application No. 10/201,468, filed on Jul. 23, 2002, now abandoned.

(51) Int. Cl.[7] ..... G03C 1/40; G03C 1/46; G03C 1/825; G03C 1/83; G03C 5/17

(52) U.S. Cl. ..... 430/139; 430/428; 430/502; 430/509; 430/966

(58) Field of Search ..... 430/139, 502, 430/509, 966, 428

(56) References Cited

U.S. PATENT DOCUMENTS

| | | | |
|---|---|---|---|
| 4,425,425 A | 1/1984 | Abbott et al. | |
| 4,425,426 A | 1/1984 | Abbott et al. | |
| 4,710,637 A | 12/1987 | Luckey et al. | |
| 4,803,150 A | 2/1989 | Dickerson et al. | |
| 4,994,355 A | 2/1991 | Dickerson et al. | |
| 4,997,750 A | 3/1991 | Dickerson et al. | |
| 5,108,881 A | 4/1992 | Dickerson et al. | |
| 5,576,156 A | 11/1996 | Dickerson | |
| 6,033,840 A | 3/2000 | Dickerson | |
| 6,037,112 A | 3/2000 | Dickerson | |
| 6,200,723 B1 * | 3/2001 | Dickerson et al. | 430/502 |

FOREIGN PATENT DOCUMENTS

| | | |
|---|---|---|
| JP | 61-116349 | 6/1986 |
| JP | 61-116354 | 6/1986 |

OTHER PUBLICATIONS

JP Abstract 61–116349.
JP Abstract 61–116354.

* cited by examiner

*Primary Examiner*—Richard L. Schilling
(74) *Attorney, Agent, or Firm*—J. Lanny Tucker

(57) ABSTRACT

An asymmetric radiographic silver halide film has two cubic grain silver halide emulsion layers on the frontside and a tabular grain silver halide emulsion layer on the backside. The cubic grain silver halide emulsion layer closer to the support also includes a crossover control agent to reduce crossover to the backside to less than 10% and is thinner than the outermost cubic grain silver halide emulsion layer. The backside of the support also includes an antihalation layer. These films are useful for imaging soft tissue as in mammography.

19 Claims, 1 Drawing Sheet

ASYMMETRIC RADIOGRAPHIC FILM FOR MAMMOGRAPHY AND METHOD OF PROCESSING

RELATED APPLICATION

This is a Continuation-in-part of U.S. Ser. No. 10/201,468 filed Jul. 23, 2002, now abandoned, by Dickerson.

FIELD OF THE INVENTION

This invention is directed to radiography. In particular, it is directed to an asymmetric radiographic silver halide film that provides improved medical diagnostic images of soft tissues such as in mammography.

BACKGROUND OF THE INVENTION

The use of radiation-sensitive silver halide emulsions for medical diagnostic imaging can be traced to Roentgen's discovery of X-radiation by the inadvertent exposure of a silver halide film. Eastman Kodak Company then introduced its first product specifically intended to be exposed by X-radiation in 1913.

In conventional medical diagnostic imaging the object is to obtain an image of a patient's internal anatomy with as little X-radiation exposure as possible. The fastest imaging speeds are realized by mounting a dual-coated radiographic element between a pair of fluorescent intensifying screens for imagewise exposure. About 5% or less of the exposing X-radiation passing through the patient is adsorbed directly by the latent image forming silver halide emulsion layers within the dual-coated radiographic element. Most of the X-radiation that participates in image formation is absorbed by phosphor particles within the fluorescent screens. This stimulates light emission that is more readily absorbed by the silver halide emulsion layers of the radiographic element.

Examples of radiographic element constructions for medical diagnostic purposes are provided by U.S. Pat. No. 4,425,425 (Abbott et al.) and U.S. Pat. No. 4,425,426 (Abbott et al.), U.S. Pat. No. 4,414,310 (Dickerson), U.S. Pat. No. 4,803,150 (Kelly et al.), U.S. Pat. No. 4,900,652 (Kelly et al.), U.S. Pat. No. 5,252,442 (Tsaur et al.), and *Research Disclosure*, Vol. 184, Aug. 1979, Item 18431.

While the necessity of limiting patient exposure to high levels of X-radiation was quickly appreciated, the question of patient exposure to even low levels of X-radiation emerged gradually. The separate development of soft tissue radiography, which requires much lower levels of X-radiation, can be illustrated by mammography. The first intensifying screen-film combination (imaging assembly) for mammography was introduced to the public in the early 1970's. Mammography film generally contains a single silver halide emulsion layer and is exposed by a single intensifying screen, usually interposed between the film and the source of X-radiation. Mammography utilizes low energy X-radiation, that is radiation predominantly of an energy level less than 40 keV.

U.S. Pat. No. 6,033,840 (Dickerson) and U.S. Pat. No. 6,037,112 (Dickerson) describe asymmetric imaging elements and processing methods for imaging soft tissue.

Problem to be Solved

In mammography, as in many forms of soft tissue radiography, pathological features that are to be identified are often quite small and not much different in density than surrounding healthy tissue. Thus, relatively high average contrast, in the range of from 2.5 to 3.5, over a density range of from 0.25 to 2.0 is typical. Limiting X-radiation energy levels increases the absorption of the X-radiation by the intensifying screen and minimizes X-radiation exposure of the film, which can contribute to loss of image sharpness and contrast. Thus, mammography is a very difficult task in medical radiography. In addition, microcalcifications must be seen when they are as small as possible to improve early detection and treatment of breast cancers. As a result, there is desire to improve the image quality of mammography films by increasing image sharpness.

SUMMARY OF THE INVENTION

This invention provides an improved radiographic silver halide film comprising a support having first and second major surfaces and that is capable of transmitting X-radiation, the radiographic silver halide film having disposed on the first major support surface, two or more hydrophilic colloid layers including first and second silver halide emulsion layers with the second silver halide emulsion layer being closer to the support and further comprising a crossover control agent, and having disposed on the second major support surface, two or more hydrophilic colloid layers including a third silver halide emulsion layer and an antihalation layer disposed over the third silver halide emulsion layer, each of the first and second silver halide emulsion layers comprising cubic silver halide grains that have the same or different composition in each silver halide emulsion layer, and the third silver halide emulsion layer comprising tabular silver halide grains, the crossover control agent being present in an amount sufficient to reduce crossover to less than 10%, and is substantially removed from the film during wet processing within 90 seconds.

This invention also provides a radiographic imaging assembly comprising a radiographic silver halide film of this invention that is arranged in association with a fluorescent intensifying screen.

Further, this invention provides a method of providing a black-and-white image comprising exposing a radiographic silver halide film of this invention and processing it, sequentially, with a black-and-white developing composition and a fixing composition, the processing being carried out within 90 seconds, dry-to-dry.

The present invention provides a means for providing radiographic images for mammography exhibiting improved image quality by providing images of improved sharpness due to reduced crossover (for example, less than 10%) of light transmitted through the support to the backside silver halide emulsion when the film is exposed using a single fluorescent intensifying screen on one side of the film (the frontside).

In addition, all other desirable sensitometric properties are maintained and the asymmetric radiographic film can be rapidly processed in the same conventional processing equipment and compositions.

These advantages are achieved by using a novel combination of emulsion layers in the radiographic film. On the frontside are two cubic grain emulsions, the emulsion layer closer to the support also comprising crossover control agent to reduce crossover through the support. The single backside emulsion includes tabular silver halide grains, and an antihalation layer is disposed over the backside emulsion layer. In addition, the two cubic grain emulsion layers are different in thickness with the emulsion layer closer to the support being thinner than the other cubic grain emulsion layer and containing a crossover control agent.

DETAILED DESCRIPTION OF THE INVENTION

Figure 1:
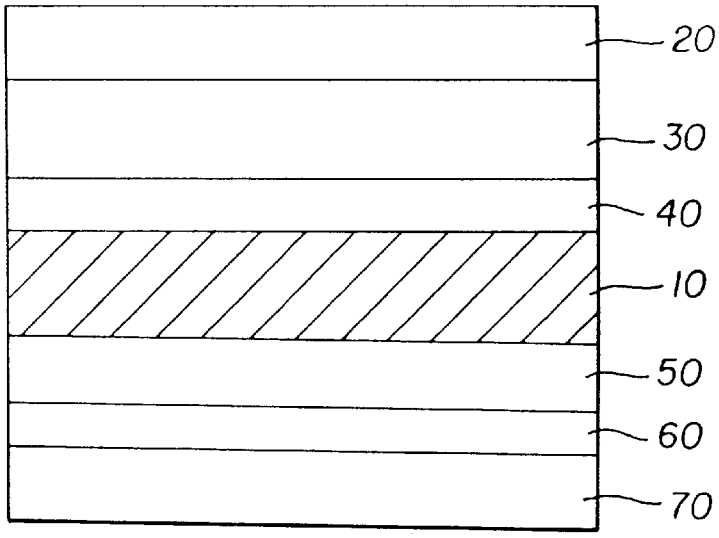
FIG. 1 is a schematic cross-sectional illustration of a radiographic silver halide film of this invention.

Definition of Terms:

The term "contrast" as herein employed indicates the average contrast derived from a characteristic curve of a radiographic film using as a first reference point (1) a density ($D_1$) of 0.25 above minimum density and as a second reference point (2) a density ($D_2$) of 2.0 above minimum density, where contrast is $\Delta D$ (i.e. 1.75)÷$\Delta\log_{10}E$ ($\log_{10}E_2 - \log_{10}E_1$), $E_1$ and $E_2$ being the exposure levels at the reference points (1) and (2).

"Gamma" is described as the instantaneous rate of change of a D logE sensitometric curve or the instantaneous contrast at any logE value.

"Photographic speed" for the radiographic films refers to the exposure necessary to obtain a density of at least 1.0 plus $D_{min}$.

The term "fully forehardened" is employed to indicate the forehardening of hydrophilic colloid layers to a level that limits the weight gain of a radiographic film to less than 120% of its original (dry) weight in the course of wet processing. The weight gain is almost entirely attributable to the ingestion of water during such processing.

The term "rapid access processing" is employed to indicate dry-to-dry processing of a radiographic film in 45 seconds or less. That is, 45 seconds or less elapse from the time a dry imagewise exposed radiographic film enters a wet processor until it emerges as a dry fully processed film.

In referring to grains and silver halide emulsions containing two or more halides, the halides are named in order of ascending molar concentrations.

The term "equivalent circular diameter" (ECD) is used to define the diameter of a circle having the same projected area as a silver halide grain.

The term "aspect ratio" is used to define the ratio of grain ECD to grain thickness.

The term "coefficient of variation" (COV) is defined as 100 times the standard deviation (a) of grain ECD divided by the mean grain ECD.

The term "covering power" is used to indicate 100 times the ratio of maximum density to developed silver measured in $mg/dm^2$.

As used herein, "crossover" refers to the % transmission of light determined using the measurement technique described in the Example below. This definition of "crossover" may not be the same as that used in other patent literature.

The term "dual-coated" is used to define a radiographic film having silver halide emulsion layers disposed on both the front- and backsides of the support. The radiographic silver halide films of the present invention are "dual-coated."

The radiographic films of the present invention are "asymmetric"meaning that they have different emulsions on opposite sides of the support.

The term "fluorescent intensifying screen" refers to a screen that absorbs X-radiation and emits light. A "prompt" emitting fluorescent intensifying screen will emit light immediately upon exposure to radiation while "storage-"fluorescent screen can "store" the exposing X-radiation for emission at a later time when the screen is irradiated with other radiation (usually visible light).

The terms "front" and "back" refer to layers, films, or fluorescent intensifying screens nearer to and farther from, respectively, the source of X-radiation.

*Research Disclosure* is published by Kenneth Mason Publications, Ltd., Dudley House, 12 North St., Emsworth, Hampshire P010 7DQ England. This publication is also available from Emsworth Design Inc., 147 West 24th Street, New York, N.Y. 10011.

The radiographic silver halide films of this invention include a flexible support having disposed on both sides thereof, photographic silver halide emulsion layers, antihalation layers, and optionally one or more other non-radiation sensitive hydrophilic layer(s). The silver halide emulsions in the various layers are defined below. In preferred embodiments, the photographic silver halide film has a protective overcoat (described below) over the silver halide emulsions and other layers on each side of the support.

The support can take the form of any conventional radiographic film support that is X-radiation and light transmissive. Useful supports for the films of this invention can be chosen from among those described in *Research Disclosure*, September 1996, Item 38957 XV. Supports and *Research Disclosure*, Vol. 184, August 1979, Item 18431, XII. Film Supports.

The support is preferably a transparent film support. In its simplest possible form the transparent film support consists of a transparent film chosen to allow direct adhesion of the hydrophilic silver halide emulsion layers or other hydrophilic layers. More commonly, the transparent film is itself hydrophobic and subbing layers are coated on the film to facilitate adhesion of the hydrophilic silver halide emulsion layers. Typically the film support is either colorless or blue tinted (tinting dye being present in one or both of the support film and the subbing layers). Referring to *Research Disclosure*, Item 38957, Section XV Supports, cited above, attention is directed particularly to paragraph (2) that describes subbing layers, and paragraph (7) that describes preferred polyester film supports.

Polyethylene terephthalate and polyethylene naphthalate are the preferred transparent film support materials.

In the more preferred embodiments, at least one non-light sensitive hydrophilic layer is included with the silver halide emulsion layers on each side of the film support. This layer may be called an interlayer or overcoat, or both.

The silver halide emulsion layers comprise one or more types of silver halide grains responsive to X-radiation. First and second silver halide emulsion layers are disposed on the frontside of the support and comprise one or more of the same or different silver halides. Preferably, both first and second silver halide emulsion layers comprise predominantly (at least 80 mol %) silver bromide grains based on total silver in each emulsion layer. Preferably at least 90 mol % of the silver halide grains in both frontside layers comprise silver bromide, based on total silver in a given emulsion layer. Such emulsions include silver halide grains composed of, for example, silver bromide, silver bromochloride, silver iodobromochloride, and silver bromoiodochloride. Iodide is generally limited to no more than 2 mol % (based on total silver in each emulsion layer) to facilitate more rapid processing. Preferably iodide is from about 0.5 to about 1.5 mol % (based on total silver in each emulsion layer) or eliminated entirely from the grains. The silver halide grains in each frontside silver halide emulsion layer can be the same or different, or mixtures of different types of grains.

The silver halide grains used in each frontside emulsion layers are predominantly (at least 50 weight %) cubic grains with the remainder of the grains having any desirable other morphology. Preferably, at least 90 weight % of the grains in each frontside silver halide emulsion layer have cubic morphology.

It may also be desirable to employ silver halide grains in each frontside emulsion layer that exhibit a coefficient of variation (COV) of grain ECD of less than 20% and, preferably, less than 10%. In some embodiments, it may be desirable to employ a grain population that is as highly monodisperse as can be conveniently realized.

The average silver halide grain size can vary within each frontside silver halide emulsion layer. For example, the average grain size in each frontside silver halide emulsion is independently and generally from about 0.8 to about 0.9 $\mu$M.

The two frontside silver halide emulsion layers preferably are of different thickness. It is preferable that the outermost emulsion layer be thicker than the emulsion layer closer to the support (greater than 1:1 dry unprocessed thickness ratio) and the dry unprocessed thickness ratio of the first to the second emulsion layer is preferably from about 4:1 to about 2:1. These thickness evaluations are made of the film before it is processed with processing solutions.

In addition, the silver halide emulsion layer closer to the support comprises one or more "crossover control agents" that are present in sufficient amounts to reduce light transmitted through the support to the backside layers to less than 10% and preferably less than 8%. Crossover is measured in the practice of this invention as noted in the example below.

Useful crossover control agents are well known in the art and include one or more compounds that provide a total density of at least 0.3 (preferably at least 0.45) and up to 0.9 at a preferred wavelength of 545 nm and that are disposed on a transparent support. The density can be measured using a standard densitometer (using "visual status"). In general, the amount of crossover control agent in the "second" silver halide emulsion layer will vary depending upon the strength of absorption of the given compound(s), but for most pigments and dyes, the amount is generally from about 25 to about 150 mg/m$^2$ (preferably from about 54 mg to about 110 mg/m$^2$).

In addition, the crossover control agents must be substantially removed within 90 seconds (preferably with 45 seconds) during processing (generally during development). By "substantially" means that the crossover control agent remaining in the film after processing provides no more than 0.05 optical density as measured using a conventional sensitometer. Removal of the crossover control agents can be achieved by their migration out of the film, but preferably, they are not physically removed but are decolorized during processing.

Pigments and dyes that can be used as crossover control agents include various water-soluble, liquid crystalline, or particulate magenta or yellow filter dyes or pigments including those described for example in U.S. Pat. No. 4,803,150 (Dickerson et al.), U.S. Pat. No. 5,213,956 (Diehl et al.), U.S. Pat. No. 5,399,690 (Diehl et al.), U.S. Pat. No. 5,922,523 (Helber et al.), U.S. Pat. No. 6,214,499 (Helber et al.), and Japanese Kokai 2-123349, all of which are incorporated herein by reference for pigments and dyes useful in the practice of this invention. One useful class of particulate dyes useful as crossover control agents includes nonionic polymethine dyes such as merocyanine, oxonol, hemioxonol, styryl, and arylidene dyes as described in U.S. Pat. No. 4,803,150 (noted above) that is incorporated herein for the definitions of those dyes. The magenta merocyanine and oxonol dyes are preferred and the oxonol dyes are most preferred.

One particularly useful magenta oxonol dye that can be used as a crossover control agent is the following compound M-1:

M-1

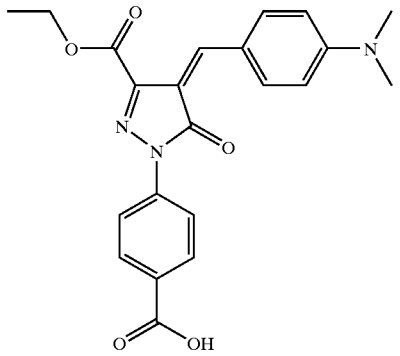

The backside ("third") silver halide emulsion layer comprises different silver halide grains. Generally, at least 50% (and preferably at least 80%) of the silver halide grain projected area in this silver halide emulsion layer is provided by tabular grains having an average aspect ratio greater than 5, and more preferably greater than 10. The remainder of the silver halide projected area is provided by silver halide grains having one or more non-tabular morphologies. In addition, the tabular grains are predominantly (at least 90 mol %) silver bromide based on the total silver in the emulsion layer with up to 1 mol % silver iodide. Preferably, the tabular grains are pure silver bromide.

Tabular grain emulsions that have the desired composition and sizes are described in greater detail in the following patents, the disclosures of which are incorporated herein by reference:

U.S. Pat. No. 4,414,310 (Dickerson), U.S. Pat. No. 4,425,425 (Abbott et al.), U.S. Pat. No. 4,425,426 (Abbott et al.), U.S. Pat. No. 4,439,520 (Kofron et al.), U.S. Pat. No. 4,434,226 (Wilgus et al.), U.S. Pat. No. 4,435,501 (Maskasky), U.S. Pat. No. 4,713,320 (Maskasky), U.S. Pat. No. 4,803,150 (Dickerson et al.), U.S. Pat. No. 4,900,355 (Dickerson et al.), U.S. Pat. No. 4,994,355 (Dickerson et al.), U.S. Pat. No. 4,997,750 (Dickerson et al.), U.S. Pat. No. 5,021,327 (Bunch et al.), U.S. Pat. No. 5,147,771 (Tsaur et al.), U.S. Pat. No. 5,147,772 (Tsaur et al.), U.S. Pat. No. 5,147,773 (Tsaur et al.), U.S. Pat. No. 5,171,659 (Tsaur et al.), U.S. Pat. No. 5,252,442 (Dickerson et al.), U.S. Pat. No. 5,370,977 (Zietlow), U.S. Pat. No. 5,391,469 (Dickerson), U.S. Pat. No. 5,399,470 (Dickerson et al.), U.S. Pat. No. 5,411,853 (Maskasky), U.S. Pat. No. 5,418,125 (Maskasky), U.S. Pat. No. 5,494,789 (Daubendiek et al.), U.S. Pat. No. 5,503,970 (Olm et al.), U.S. Pat. No. 5,536,632 (Wen et al.), U.S. Pat. No. 5,518,872 (King et al.), U.S. Pat. No. 5,567,580 (Fenton et al.), U.S. Pat. No. 5,573,902 (Daubendiek et al.), U.S. Pat. No. 5,576,156 (Dickerson), U.S. Pat. No. 5,576,168 (Daubendiek et al.), U.S. Pat. No. 5,576,171 (Olm et al.), and U.S. Pat. No. 5,582,965 (Deaton et al.). The patents to Abbott et al., Fenton et al., Dickerson, and Dickerson et al. are also cited and incorporated herein to show conventional radiographic film features in addition to gelatino-vehicle, high bromide (≧80 mol % bromide based on total silver) tabular grain emulsions and other features useful in the present invention. The preferred tabular grains in the third silver halide emulsion layer have an average thickness of from about 0.07 to about 0.1 μm.

The backside of the radiographic silver halide film also includes an antihalation layer disposed over the third silver halide emulsion layer. This layer comprises one or more antihalation dyes or pigments dispersed on a suitable hydrophilic binder (described below). In general, such antihalation dyes or pigments are chosen to absorb whatever radiation the film is likely to be exposed to from a fluorescent intensifying screen. Such dyes or pigments can be the same or different as the dyes and pigments identified above as crossover control agents (such as the nonionic polymethine dyes). The amounts of such dyes or pigments present in the antihalation layer are generally from about 150 to about 250 $mg/m^2$. A particularly useful antihalation dye is the magenta filter dye M-1 identified above.

A variety of silver halide dopants can be used, individually and in combination, in one or more of the silver halide emulsion layers to improve contrast as well as other common sensitometric properties. A summary of conventional dopants is provided by *Research Disclosure*, Item 38957, cited above, Section I. Emulsion grains and their preparation, sub-section D. Grain modifying conditions and adjustments, paragraphs (3), (4), and (5).

A general summary of silver halide emulsions and their preparation is provided by Research Disclosure, Item 38957, cited above, Section I. Emulsion grains and their preparation. After precipitation and before chemical sensitization the emulsions can be washed by any convenient conventional technique using techniques disclosed by Research Disclosure, Item 38957, cited above, Section III. Emulsion washing.

Any of the emulsions can be chemically sensitized by any convenient conventional technique as illustrated by *Research Disclosure*, Item 38957, Section IV. Chemical Sensitization: Sulfur, selenium or gold sensitization (or any combination thereof) are specifically contemplated. Sulfur sensitization is preferred, and can be carried out using for example, thiosulfates, thiosulfonates, thiocyanates, isothiocyanates, thioethers, thioureas, cysteine or rhodanine. A combination of gold and sulfur sensitization is most preferred.

In addition, if desired, any of the silver halide emulsions can include one or more suitable spectral sensitizing dyes, for example cyanine and merocyanine spectral sensitizing dyes. The useful amounts of such dyes are well known in the art but are generally within the range of from about 200 to about 1000 mg/mole of silver in the given emulsion layer.

Instability that increases minimum density in negative-type emulsion coatings (that is fog) can be protected against by incorporation of stabilizers, antifoggants, antikinking agents, latent-image stabilizers and similar addenda in the emulsion and contiguous layers prior to coating. Such addenda are illustrated by Research Disclosure, Item 38957, Section VII. Antifoggants and stabilizers, and Item 18431, Section II: Emulsion Stabilizers, Antifoggants and Antikinking Agents.

It may also be desirable that one or more silver halide emulsion layers include one or more covering power enhancing compounds adsorbed to surfaces of the silver halide grains. A number of such materials are known in the art, but preferred covering power enhancing compounds contain at least one divalent sulfur atom that can take the form of a —S— or ═S moiety. Such compounds include, but are not limited to, 5-mercapotetrazoles, dithioxotriazoles, mercapto-substituted tetraazaindenes, and others described in U.S. Pat. No. 5,800,976 (Dickerson et al.) that is incorporated herein by reference for the teaching of the sulfur-containing covering power enhancing compounds.

The silver halide emulsion layers and other hydrophilic layers on both sides of the support of the radiographic films of this invention generally contain conventional polymer vehicles (peptizers and binders) that include both synthetically prepared and naturally occurring colloids or polymers. The most preferred polymer vehicles include gelatin or gelatin derivatives alone or in combination with other vehicles. Conventional gelatino-vehicles and related layer features are disclosed in *Research Disclosure*, Item 38957, Section II. Vehicles, vehicle extenders, vehicle-like addenda and vehicle related addenda. The emulsions themselves can contain peptizers of the type set out in Section II, paragraph A. Gelatin and hydrophilic colloid peptizers. The hydrophilic colloid peptizers are also useful as binders and hence are commonly present in much higher concentrations than required to perform the peptizing function alone. The preferred gelatin vehicles include alkali-treated gelatin, acid-treated gelatin or gelatin derivatives (such as acetylated gelatin, deionized gelatin, oxidized gelatin, and phthalated gelatin). Cationic starch used as a peptizer for tabular grains is described in U.S. Pat. No. 5,620,840 (Maskasky) and U.S. Pat. No. 5,667,955 (Maskasky). Both hydrophobic and hydrophilic synthetic polymeric vehicles can be used also. Such materials include, but are not limited to, polyacrylates (including polymethacrylates), polystyrenes and polyacrylamides (including polymethacrylamides). Dextrans can also be used. Examples of such materials are described for example in U.S. Pat. No. 5,876,913 (Dickerson et al.), incorporated herein by reference.

The silver halide emulsion layers (and other hydrophilic layers) in the radiographic films are generally hardened to various degrees using one or more conventional hardeners.

Conventional hardeners can be used for this purpose, including but not limited to formaldehyde and free dialdehydes such as succinaldehyde and glutaraldehyde, blocked dialdehydes, α-diketones, active esters, sulfonate esters, active halogen compounds, s-triazines and diazines, epoxides, aziridines, active olefins having two or more active bonds, blocked active olefins, carbodiimides, isoxazolium salts unsubstituted in the 3-position, esters of 2-alkoxy-N-carboxydi-hydroquinoline, N-carbamoyl pyridinium salts, carbamoyl oxypyridinium salts, bis(amidino) ether salts, particularly bis(amidino) ether salts, surface-applied carboxyl-activating hardeners in combination with complex-forming salts, carbamoylonium, carbamoyl pyridinium and carbamoyl oxypyridinium salts in combination with certain aldehyde scavengers, dication ethers, hydroxylamine esters of imidic acid salts and chloroformamidinium salts, hardeners of mixed function such as halogen-substituted aldehyde acids (for example, mucochloric and mucobromic acids), onium-substituted acroleins, vinyl sulfones containing other hardening functional groups, polymeric hardeners such as dialdehyde starches, and poly (acrolein-co-methacrylic acid).

The levels of silver and polymer vehicle in the radiographic silver halide film used in the present invention are not critical. In general, the total amount of silver in the first, second, and third silver halide emulsion layers are at least 25, 5, and 5 and no more than 40, 15, and 15 $mg/dm^2$, respectively. In addition, the total coverage of polymer vehicle in the first, second, and third silver halide emulsion layers is generally at least 20, 5, and 5 and no more than 30, 15, and 15 mg/dm$^2$, respectively. These amounts refer to dry weights.

The radiographic silver halide films of this invention generally include a surface protective overcoat disposed on each side of the support that typically provides physical protection of the emulsion and other layers. Each protective overcoat can be sub-divided into two or more individual layers. For example, protective overcoats can be sub-divided into surface overcoats and interlayers (between the overcoat and silver halide emulsion layers). In addition to vehicle features discussed above the protective overcoats can contain various addenda to modify the physical properties of the overcoats. Such addenda are illustrated by *Research Disclosure*, Item 38957, Section IX. Coating physical property modifying addenda, A. Coating aids, B. Plasticizers and lubricants, C. Antistats, and D. Matting agents. Interlayers that are typically thin hydrophilic colloid layers can be used to provide a separation between various layers. The overcoat on at least one side of the support can also include a blue toning dye or a tetraazaindene (such as 4-hydroxy-6-methyl-1,3,3a,7-tetraazaindene) if desired.

The protective overcoat is generally comprised of one or more hydrophilic colloid vehicles, chosen from among the same types disclosed above in connection with the emulsion layers. Protective overcoats are provided to perform two basic functions. They provide a layer between the emulsion layers and the surface of the film for physical protection of the emulsion layer during handling and processing. Secondly, they provide a convenient location for the placement of addenda, particularly those that are intended to modify the physical properties of the radiographic film. The protective overcoats of the films of this invention can perform both these basic functions.

The various coated layers of radiographic silver halide films of this invention can also contain tinting dyes to modify the image tone to transmitted or reflected light. These dyes are not decolorized during processing and may be homogeneously or heterogeneously dispersed in the various layers. Preferably, such non-bleachable tinting dyes are in a silver halide emulsion layer.

Preferred embodiments of this invention include radiographic silver halide films comprising a transparent support having first and second major surfaces, that is capable of transmitting X-radiation, and that is designed to be used with a single fluorescent intensifying screen, the radiographic silver halide film having disposed on the first major support surface, two or more hydrophilic colloid layers including first and second silver halide emulsion layers wherein the second silver halide emulsion layer being closer to the support and further comprising a crossover control agent, the dry, unprocessed thickness of the first to the second silver halide emulsion layers being from about 4:1 to about 2:1, both of the first and second silver halide emulsion layers comprising the same cubic silver halide grains comprising at least 90 mol % silver bromide based on total silver in each emulsion layer, the crossover control agent comprising a particulate merocyanine or oxonol dye in an amount of from about 54 to about 110 mg/m$^2$ to reduce crossover to less than 8% and that is decolorized during processing within 45 seconds, and disposed on the second major support surface, two or more hydrophilic colloid layers including a third silver halide emulsion layer and an antihalation layer, the third silver halide emulsion layer comprising predominantly tabular silver bromide tabular grains having a aspect ratio of at least 10:1 and an average thickness of from about 0.07 to about 0.1 $\mu$m, the antihalation layer comprising an oxonol magenta filter dye.

The radiographic imaging assemblies of the present invention are composed of one radiographic silver halide film as described herein and at least one (preferably a single) fluorescent intensifying screen that preferably has a photographic speed of at least 200. Fluorescent intensifying screens are typically designed to absorb X-rays and to emit electromagnetic radiation having a wavelength greater than 300 nm. These screens can take any convenient form providing they meet all of the usual requirements for use in radiographic imaging. Examples of conventional, useful fluorescent intensifying screens are provided by *Research Disclosure*, Item 18431, cited above, Section IX. X-Ray Screens/Phosphors, and U.S. Pat. No. 5,021,327 (Bunch et al.), U.S. Pat. No. 4,994,355 (Dickerson et al.), U.S. Pat. No. 4,997,750 (Dickerson et al.), and U.S. Pat. No. 5,108,881 (Dickerson et al.), the disclosures of which are here incorporated by reference. The fluorescent layer contains phosphor particles and a binder, optimally additionally containing a light scattering material, such as titania.

Any conventional or useful phosphor can be used, singly or in mixtures, in the intensifying screens used in the practice of this invention. For example, useful phosphors are described in numerous references relating to fluorescent intensifying screens, including but not limited to, *Research Disclosure*, Vol. 184, August 1979, Item 18431, Section IX, X-ray Screens/Phosphors, and U.S. Pat. No. 2,303,942 (Wynd et al.), U.S. Pat. No. 3,778,615 (Luckey), U.S. Pat. No. 4,032,471 (Luckey), U.S. Pat. No. 4,225,653 (Brixner et al.), U.S. Pat. No. 3,418,246 (Royce), U.S. Pat. No. 3,428,247 (Yocon), U.S. Pat. No. 3,725,704 (Buchanan et al.), U.S. Pat. No. 2,725,704 (Swindells), U.S. Pat. No. 3,617,743 (Rabatin), U.S. Pat. No. 3,974,389 (Ferri et al.), U.S. Pat. No. 3,591,516 (Rabatin), U.S. Pat. No. 3,607,770 (Rabatin), U.S. Pat. No. 3,666,676 (Rabatin), U.S. Pat. No. 3,795,814 (Rabatin), U.S. Pat. No. 4,405,691 (Yale), U.S. Pat. No. 4,311,487 (Luckey et al.), U.S. Pat. No. 4,387,141 (Patten), U.S. Pat. No. 5,021,327 (Bunch et al.), U.S. Pat. No. 4,865,944 (Roberts et al.), U.S. Pat. No. 4,994,355 (Dickerson et al.), U.S. Pat. No. 4,997,750 (Dickerson et al.), U.S. Pat. No. 5,064,729 (Zegarski), U.S. Pat. No. 5,108,881 (Dickerson et al.), U.S. Pat. No. 5,250,366 (Nakajima et al.), U.S. Pat. No. 5,871,892 (Dickerson et al.), EP-A-0 491,116 (Benzo et al.), the disclosures of all of which are incorporated herein by reference with respect to the phosphors.

An embodiment of the radiographic film of the present invention is illustrated in FIG. 1. On the frontside of support 10 are disposed overcoat 20, first emulsion layer 30, and second emulsion layer 40 that includes a crossover control agent. On the backside of support 10 are disposed third emulsion layer 50, antihalation layer 60, and overcoat 70.

Figure 2:
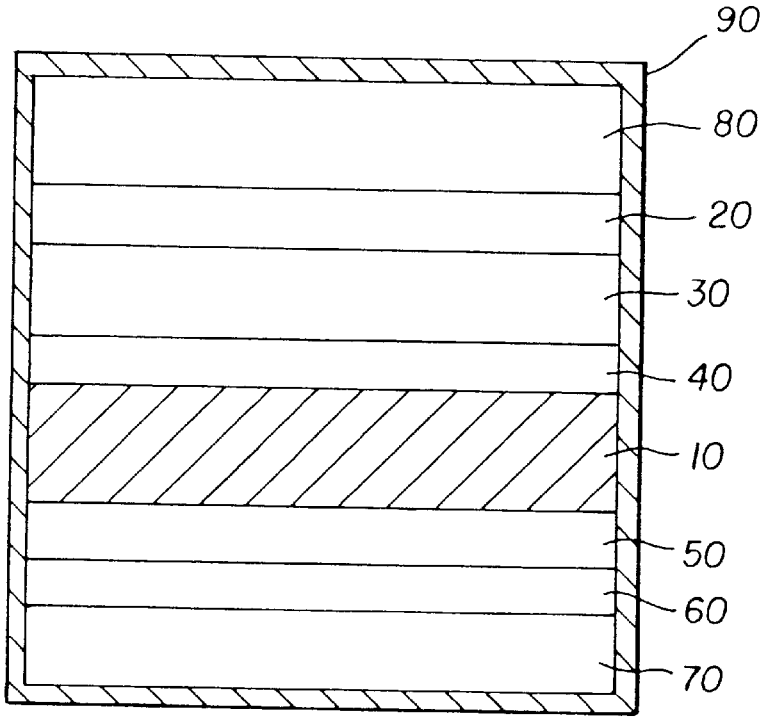
FIG. 2 is a schematic cross-sectional illustration of a radiographic imaging assembly of this invention comprising a radiographic film of this invention arranged in association with a single fluorescent intensifying screen in a cassette holder.

FIG. 2 shows the radiographic film of FIG. 1 that is arranged in association with fluorescent intensifying screen 80 on the frontside, and both in cassette holder 90.

Exposure and processing of the radiographic silver halide films can be undertaken in any convenient conventional manner. The exposure and processing techniques of U.S. Pat. Nos. 5,021,327 and 5,576,156 (both noted above) are typical for processing radiographic films. Other processing compositions (both developing and fixing compositions) are described in U.S. Pat. No. 5,738,979 (Fitterman et al.), U.S. Pat. No. 5,866,309 (Fitterman et al.), U.S. Pat. No. 5,871,890 (Fitterman et al.), U.S. Pat. No. 5,935,770 (Fitterman et al.), U.S. Pat. No. 5,942,378 (Fitterman et al.), all incorporated herein by reference. The processing compositions can be supplied as single- or multi-part formulations, and in concentrated form or as more diluted working strength solutions.

Exposing X-radiation is generally directed through a single fluorescent intensifying screen before it passes through the radiographic silver halide film for imaging of soft tissue such as breast tissue.

It is particularly desirable that the radiographic silver halide films of this invention be processed within 90 seconds ("dry-to-dry") and preferably within 60 seconds and at least 20 seconds, for the developing, fixing and any washing (or rinsing) steps. Such processing can be carried out in any suitable processing equipment including but not limited to, a Kodak X-OMAT™ RA 480 processor that can utilize Kodak Rapid Access processing chemistry. Other "rapid access processors" are described for example in U.S. Pat. No. 3,545,971 (Barnes et al.) and EP 0 248,390A1 (Akio et al.). Preferably, the black-and-white developing compositions used during processing are free of any photographic film hardeners, such as glutaraldehyde.

Radiographic kits can include a radiographic silver halide film or a radiographic imaging assembly of this invention, and one or more additional fluorescent intensifying screens and/or metal screens, and/or one or more suitable processing compositions (for example black-and-white developing and fixing compositions).

The following example is presented for illustration and the invention is not to be interpreted as limited thereby.

Example:

Radiographic Film A (Control):

Radiographic Film A was a dual-coated radiographic film with ⅔ of the silver and gelatin coated on one side of the blue-tinted poly(ethylene terephthalate) support (170 μm) and the remainder coated on the opposite side of the support. It also included a halation control layer containing solid particle dyes to provide improved sharpness. The film contained green-sensitized high aspect ratio tabular silver bromide grains. Such grains are defined in U.S. Pat. No. 4,425,425 (Abbott et al.) and have at least 50% of the total grain projected area accounted for by tabular grains having a thickness of less than 0.3 μm and having an average aspect ratio greater than 8:1. The emulsion was polydisperse in distribution and had a coefficient of variation of 38. The emulsion was spectrally sensitized with 400 mg/silver mole of anhydro-5,5-dichloro-9-ethyl-3,3'-bis(3-sulfopropyl) oxacarbocyanine hydroxide, followed by 300 mg/silver mole of potassium iodide. Film A had the following layer arrangement and formulations on the film support:

Overcoat 1
Interlayer
Emulsion Layer 1
Support
Emulsion Layer 2
Halation Control Layer
Overcoat 2

| | Coverage (mg/dm$^2$) |
|---|---|
| Overcoat I Formulation | |
| Gelatin vehicle | 4.4 |
| Methyl methacrylate matte beads | 0.35 |
| Carboxymethyl casein | 0.73 |

-continued

| | Coverage (mg/dm$^2$) |
|---|---|
| Colloidal silica (LUDOX AM) | 1.1 |
| Polyacrylamide | 0.85 |
| Chrome alum | 0.032 |
| Resorcinol | 0.73 |
| Dow Corning Silicone | 0.153 |
| TRITON X-200 surfactant (From Union Carbide) | 0.26 |
| LODYNE S-100 surfactant (From Ciba Specialty Chemical) | 0.0097 |
| Interlayer Formulation | |
| Gelatin vehicle | 4.4 |
| Emulsion Layer I Formulation | |
| Cubic grain emulsion [AgBr 0.85 μm average size] | 40.3 |
| Gelatin vehicle | 30.6 |
| 4-Hydroxy-6-methyl-1,3,3a,7-tetraazaindene | 1 g/Ag mole |
| 1-(3-Acetamidophenyl)-5-mercaptotetrazole | 0.026 |
| Maleic acid hydrazide | 0.0076 |
| Catechol disulfonate | 0.2 |
| Glycerin | 0.22 |
| Potassium bromide | 0.13 |
| Resorcinol | 2.12 |
| Bisvinylsulfonylmethane | 0.4% based on total gelatin in all layers on that side |
| Emulsion Layer 2 Formulation | |
| Tabular grain emulsion [AgBr 2.0 × 0.10 μm average size] | 10.8 |
| Gelatin vehicle | 16.1 |
| 4-Hydroxy-6-methyl-1,3,3a,7-tetraazaindene | 2.1 g/Ag mole |
| Maleic acid hydrazide | 0.0032 |
| Catechol disulfonate | 0.2 |
| Glycerin | 0.11 |
| Potassium bromide | 0.06 |
| Resorcinol | 1.0 |
| Bisvinylsulfonylmethane | 2% based on total gelatin in all layers on that side |
| Halation Control Layer | |
| Magenta dye M-1 (noted above) | 2.2 |
| Gelatin | 10.8 |
| Overcoat 2 Formulation | |
| Gelatin vehicle | 8.8 |
| Methyl methacrylate matte beads | 0.14 |
| Carboxymethyl casein | 1.25 |
| Colloidal silica (LUDOX AM) | 2.19 |
| Polyacrylamide | 1.71 |
| Chrome alum | 0.066 |
| Resorcinol | 0.15 |
| Dow Corning Silicone | 0.16 |
| TRITON X-200 surfactant | 0.26 |
| LODYNE S-100 surfactant | 0.01 |

Radiographic Film B (Invention)

Film B was similar to Film A but was changed in several critical respects (Emulsion Layer 1 was split into two parts, the emulsion layer closer to the support also contained magenta dye M-1, and the amount of magenta dye M-1 in the antihalation layer was reduced). The overcoat and interlayer formulations were the same in both films. Emulsion Layer 3 in Film B was the same as Emulsion Layer 2 in Film A.

Overcoat 1
Interlayer
Emulsion Layer 1
Emulsion Layer 2

Support
Emulsion Layer 3
Halation Control Layer
Overcoat 2

| | Coverage (mg/dm$^2$) |
|---|---|
| Emulsion Layer 1 Formulation | |
| Cubic grain emulsion [AgBr 0.85 $\mu$m average size] | 30.6 |
| Gelatin vehicle | 22.6 |
| 4-Hydroxy-6-methyl-1,3,3a,7-tetraazaindene | 1 |
| | g/Ag mole |
| 1-(3-Acetamidophenyl)-5-mercaptotetrazole | 0.026 |
| Maleic acid hydrazide | 0.0076 |
| Catechol disulfonate | 0.2 |
| Glycerin | 0.22 |
| Potassium bromide | 0.13 |
| Resorcinol | 2.12 |
| Bisvinylsulfonylmethane | 0.4% based on total gelatin in all layers on that side |
| Emulsion Layer 2 Formulation | |
| Cubic grain emulsion [AgBr 0.85 $\mu$m average size] | 9.7 |
| Gelatin vehicle | 8.1 |
| 4-Hydroxy-6-methyl-1,3,3a,7-tetraazaindene | 1 |
| | g/Ag mole |
| 1-(3-Acetamidophenyl)-5-mercaptotetrazole | 0.026 |
| Maleic acid hydrazide | 0.0076 |
| Catechol disulfonate | 0.2 |
| Glycerin | 0.22 |
| Potassium bromide | 0.13 |
| Resorcinol | 2.12 |
| Magenta dye M-1 (noted above) | 1.1 |
| Halation Control Layer | |
| Magenta dye M-1 (noted above) | 1.1 |
| Gelatin | 10.8 |

Radiographic Film C (Invention)

Film C was like Film B except that the silver halide grains in Emulsion Layer 3 was replaced with larger silver bromide tabular grains (2.9×0.085 $\mu$m).

Image quality of the backside emulsion layer ("third" emulsion layer) was obtained by exposing the film using a phantom breast test object and a conventional KODAK MinR-2000 fluorescent intensifying screen followed by conventional processing (noted below). After processing, the frontside emulsion layer(s) were removed and a visual ranking of image sharpness of the backside emulsion was done. "Log E at Density=3.6" is a measurement of the photographic speed of the backside emulsion layer. It is the speed at which one obtains a density of 3.6 relative to the initial speed value as measured at a density of 1.2.

"% Light transmittance" is an estimate of the % light crossover. It is a spectral measurement of the light transmitted at 550 nm and 490 nm that are the two main emission peaks of the conventional Kodak MinR2000 fluorescent intensifying screen. These two peaks make up about 98% of the total screen emission at the maximum spectral sensitivity of the film. The ratio of light at 550 to the light at 490 nm is about 85:15. The following equation was used to calculate the % light transmittance ("%LT"):

%LT=0.85* (% transmittance at 550 nm)+0.15*(%transmittance at 490 nm).

Samples of the films were processed using a processor commercially available under the trademark KODAK RP X-OMAT® film Processor M6A-N, M6B, or M35A. Development was carried out using the following black-and-white developing composition:

| | |
|---|---|
| Hydroquinone | 30 g |
| Phenidone | 1.5 g |
| Potassium hydroxide | 21 g |
| $NaHCO_3$ | 7.5 g |
| $K_2SO_3$ | 44.2 g |
| $Na_2S_2O_5$ | 12.6 g |
| Sodium bromide | 35 g |
| 5-Methylbenzotriazole | 0.06 g |
| Glutaraldehyde | 4.9 g |
| Water to 1 liter, pH 10 | |

The film samples were processed in each instance for less than 90 seconds. Fixing was carried out using KODAK RP X-OMAT® LO Fixer and Replenisher fixing composition (Eastman Kodak Company).

The following TABLE I shows the comparative results of Films A–C. It is apparent from the data that Films B and C of the present invention provide increased sharpness in the backside emulsion layer by limiting the amount of transmittance (reduced crossover). Film C provided the best results with little loss in contrast and speed.

TABLE I

| Film | Relative Speed | Contrast | Log E at density 3.6 | % Light Trans-mittance | Secondary Layer Image Quality |
|---|---|---|---|---|---|
| A (Control) | 427 | 3.5 | −0.7 | 11 | Low |
| B (Invention) | 420 | 3.0 | −1.0 | 6 | High |
| D (Invention) | 425 | 3.3 | −0.7 | 5 | High |

The invention has been described in detail with particular reference to preferred embodiments thereof, but it will be understood that variations and modifications can be effected within the spirit and scope of the invention.

I claim:

1. A radiographic silver halide film comprising a support having first and second major surfaces and that is capable of transmitting X-radiation, said radiographic silver halide film having disposed on said first major support surface, two or more hydrophilic colloid layers including first and second silver halide emulsion layers wherein said second silver halide emulsion layer being closer to said support and further comprising a crossover control agent, and having disposed on said second major support surface, two or more hydrophilic colloid layers including a third silver halide emulsion layer and an antihalation layer, each of said first and second silver halide emulsion layers comprising cubic silver halide grains that have the same or different composition in each silver halide emulsion layer, and said third silver halide emulsion layer comprising tabular silver halide grains, said crossover control agent being present in an amount sufficient to reduce crossover to less than 10%, and is substantially removed from said film during wet processing within 90 seconds.

2. The radiographic silver halide film of claim 1 wherein said cubic silver halide grains of said first and second silver halide emulsion layers are independently composed of at least 80 mol % bromide based on total silver in the emulsions.

3. The radiographic silver halide film of claim 1 wherein said cubic silver halide grains of said first and second silver halide emulsions have the same composition.

4. The radiographic silver halide film of claim 1 further comprising a protective overcoat disposed on each side of said film support.

5. The radiographic silver halide film of claim 1 wherein the dry, unprocessed thickness ratio of said first silver halide emulsion layer to that of said second silver halide emulsion layer is greater than 1:1.

6. The radiographic silver halide film of claim 1 wherein the dry, unprocessed thickness ratio of said first silver halide emulsion layer to that of said second silver halide emulsion layer is from about 4:1 to about 2:1.

7. The radiographic silver halide film of claim 1 wherein the amount of polymer vehicle in said first silver halide emulsion layer is from about 20 to about 30 mg/dm$^2$, the amount of polymer vehicle in said second silver halide emulsion layer is from about 5 to about 15 mg/(dm$^2$, the amount of silver in said first silver halide layer is from about 25 to about 40 mg/dm$^2$, and the amount of silver in said second silver halide emulsion layer is from about 5 to about 15 mg/dm$^2$.

8. The radiographic silver halide film of claim 1 wherein the amount of polymer vehicle in said third silver halide emulsion layer is from about 5 to about 15 mg/dm$^2$, and the amount of silver in said third silver halide emulsion layer is from about 5 to about 15 mg/dm$^2$.

9. The radiographic silver halide film of claim 1 wherein said crossover control agent is a particulate nonionic polymethine dye and is present in an amount sufficient to reduce crossover to less than 8%.

10. The radiographic silver halide film of claim 9 wherein said crossover control agent is a particulate merocyanine or oxonol dye.

11. The radiographic silver halide film of claim 9 wherein said crossover control agent is a magenta oxonol dye.

12. The radiographic silver halide film of claim 1 wherein said crossover control agent is present in an amount of from about 25 to about 150 mg/m$^2$.

13. The radiographic silver halide film of claim 1 wherein said antihalation layer comprises a particulate nonionic polymethine dye.

14. A radiographic silver halide film comprising a transparent support having first and second major surfaces, that is capable of transmitting X-radiation, and that is designed to be used with a single fluorescent intensifying screen, said radiographic silver halide film having disposed on said first major support surface, two or more hydrophilic colloid layers including first and second silver halide emulsion layers wherein said second silver halide emulsion layer being closer to said support and further comprising a crossover control agent, the dry, unprocessed thickness ratio of said first to said second silver halide emulsion layers being from about 4:1 to about 2:1, both of said first and second silver halide emulsion layers comprising the same cubic silver halide grains comprising at least 90 mol % silver bromide based on total silver in each emulsion layer, said crossover control agent comprising a particulate merocyanine or oxonol dye in an amount of from about 54 to about 110 mg/m$^2$ to reduce crossover to less than 8% and that is decolorized during processing within 45 seconds, and disposed on said second major support surface, two or more hydrophilic colloid layers including a third silver halide emulsion layer and an antihalation layer, said third silver halide emulsion layer comprising predominantly tabular silver bromide tabular grains having a aspect ratio of at least 10:1 and an average thickness of from about 0.07 to about 0.1 $\mu$m, said antihalation layer comprising an oxonol magenta filter dye.

15. A radiographic imaging assembly comprising the radiographic silver halide film of claim 1 that is arranged in association with a fluorescent intensifying screen.

16. The radiographic imaging assembly of claim 15 comprising a single fluorescent intensifying screen.

17. A method of providing a black-and-white image comprising exposing the radiographic silver halide film of claim 1 and processing it, sequentially, with a black-and-white developing composition and a fixing composition, the processing being carried out within 90 seconds, dry-to-dry.

18. The method of claim 17 wherein said black-and-white developing composition is free of any photographic film hardeners.

19. The method of claim 17 being carried out for 60 seconds or less.

* * * * *